United States Patent [19]

Boaz

[11] 4,246,467

[45] Jan. 20, 1981

[54] ELECTRIC TERMINAL FOR CONNECTING A HEATING GRID ON A THERMAL WINDOW

[75] Inventor: Premakaran T. Boaz, Livonia, Mich.

[73] Assignee: Ford Motor Company, Dearborn, Mich.

[21] Appl. No.: 59,350

[22] Filed: Jul. 20, 1979

[51] Int. Cl.[3] ..... H05B 3/06

[52] U.S. Cl. ..... 219/522; 29/620; 219/203; 219/541; 219/543; 338/309; 339/275 R

[58] Field of Search ..... 219/203, 522, 541, 543; 174/54; 339/258 S, 275 R, 275 B; 338/217, 308, 309, 316, 327; 29/611, 620

[56] References Cited

U.S. PATENT DOCUMENTS

| | | | |
|---|---|---|---|
| Re. 28,295 | 1/1975 | Peetz et al. | 219/522 |
| 3,553,833 | 1/1971 | Jochim et al. | 219/203 X |
| 3,813,519 | 5/1974 | Jochim et al. | 219/522 |
| 4,023,008 | 5/1977 | Durussel | 219/522 |

FOREIGN PATENT DOCUMENTS

| | | | |
|---|---|---|---|
| 2810800 | 9/1978 | Fed. Rep. of Germany | 219/543 |

*Primary Examiner*—Volodymyr Y. Mayewsky

*Attorney, Agent, or Firm*—William E. Johnson; Keith L. Zerschling

[57] ABSTRACT

This invention sets forth the details of an electrical terminal for connecting a heating grid on a thermal window to a source of electric power. In general, such terminals have at least one bonding foot and a lead area to which an electrical connection can be made. The improved terminal of this specification is one in which the bonding foot is formed so as to have at least a first planar portion and a second planar portion interconnected by an interconnecting portion. The first and the second planar portions extend in spaced but substantially parallel planes. By such a construction, when the terminal is solder bonded to a heating grid on a terminal window, the first planar portion of the bonding foot is in close proximity to the heating grid and the second planar portion of the bonding foot is spaced from but interconnected by solder with the heating grid.

10 Claims, 7 Drawing Figures

ELECTRIC TERMINAL FOR CONNECTING A HEATING GRID ON A THERMAL WINDOW

BACKGROUND OF THE INVENTION AND PRIOR ART STATEMENT

This invention relates to an electrical terminal for connecting a heating grid on a thermal window to a source of electric power. Basically, the invention resides in adapting this structure so that it may be more easily soldered to such a heating grid on a thermal window. By being easily soldered, I mean that the electrical terminal can be soldered to the heating grid in a manner which insures that the electric terminal will be securely bonded to the heating grid and not easily dislodged therefrom if hit by another object. The utility of this electric terminal will become apparent upon further reading of this specification.

The most pertinent prior art that I am aware of includes reissue patent No. 28,295 and U.S. Pat. No. 4,023,008. Both of these patents disclose electric terminals used for connecting a heating grid on a thermal window to a source of electric power. In both of the patents, the electric terminal includes at least one bonding foot which is bonded to the heating grid by means of solder and a lead area to which an electrical connection can be made. In both of the patented structures the bonding feet, identified by the numerals 5 and 6 in Re. No. 28,295, and the numerals 6 and *6a* in U.S. Pat. No. 4,023,008, are planar members.

In the normal course of manufacturing of such a terminal, solder is predeposited on the bonding feet. When it is desired to attach the terminal to the heating grid, an operator places the terminal on the heating grid in such a manner that the predeposited areas of solder on the bonding feet are in contact with the heating grid. Thereafter, an operator moves a resistance soldering gun into contact with the bonding feet and energizes the gun so that a current flows through the bonding feet. The current flowing through the bonding feet heats the solder to melt the same and thus causes the bonding of the terminal to the heating grid.

The difficulty with the previous operation has been that in many instances the operator would apply too great a pressure to the resistance soldering gun during the soldering operation. The application of too great a pressure causes two difficulties. The first difficulty is that the application of too much pressure causes a squeezing out of the solder from between the bonding feet and the heating grid resulting in a weakened solder joint. The second difficulty is that the application of too great a pressure generally will cause a dissolution of silver metal which is normally found in the heating grid, which also causes a weakening of the solder joint being formed between the heating grid and the terminal being bonded thereto.

In some instances, the application of pressure to the bonding feet of the terminal during the soldering operation is insufficient and an excessive amount of solder is left at the soldering junction. This excess of solder provides a very weak junction between the terminal and the heating grid. An excessive amount of solder can also cause a canting of the terminal with respect to the heating grid. Either of these conditions mean that the terminal is not securely bonded to the heating grid and may be easily dislodged therefrom if impacted by another object.

The terminal of this invention eliminates the difficulties described above. The operator may press the terminal of this invention with as great a force as he or she desires, but yet the bonding between the terminal and the heating grid will be uniform and will be sufficient to insure the retention of the terminal by the heating grid. The advantages of the structure of this invention will be understood thoroughly after a reading of this specification.

SUMMARY OF THE INVENTION

This invention relates to an electrical terminal, and, more particularly, to an electrical terminal for connecting a heating grid on a thermal window to a source of electric power. In general, such an electric terminal has at least one bonding foot and a lead area to which an electrical connection can be made.

In accordance with the teachings of this invention, the improved electrical terminal includes a bonding foot formed so as to have at least a first planar portion and a second planar portion, with an interconnecting portion interconnecting the first and the second planar portions. The first and the second planar portions extend in a spaced but substantially parallel plane so that when the terminal is solder bonded to a heating grid on a thermal window, the first planar portion of the bonding foot is in close proximity to the heating grid, while the second planar portion of the bonding foot is spaced from but is interconnected by the solder with the heating grid. By such a construction, no matter how much pressure is applied to the first planar portion during bonding of the terminal, sufficient solder is placed between the second planar portion and the heating grid so that a good solder bond is achieved between the terminal and the heating grid.

The first planar portion may take the form of several different shapes. For example, it may be rectangular in configuration, circular in configuration, or formed by more than one area. As an additional matter, more than one bonding foot may be used for each terminal. Preferably, I desire that the terminal have a pair of bonding feet, one on each side of the lead area of the terminal to which the electrical connection is made. I also prefer that the bonding feet on each terminal be formed in the same manner, but one may form each different if desired for a particular application so long as each bonding foot has the first and the second planar areas spaced from one another.

I have also found that it is necessary to deform an area of the terminal into the first planar area so that the first planar area has sufficient rigidity that the terminal is not deflected when a load is applied thereto. For example, if one simply bent the edges of the bonding feet downwardly when such a terminal construction is applied to a heating grid, the terminal has a degree of resiliency and may spring back and forth during the soldering operation which would, in effect, produce a poor solder bond.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in conjunction with the accompanying drawings wherein like reference characters indicate like parts throughout the several figures, and in which:

DESCRIPTION OF THE PREFERRED EMBODIMENT

Figure 1:
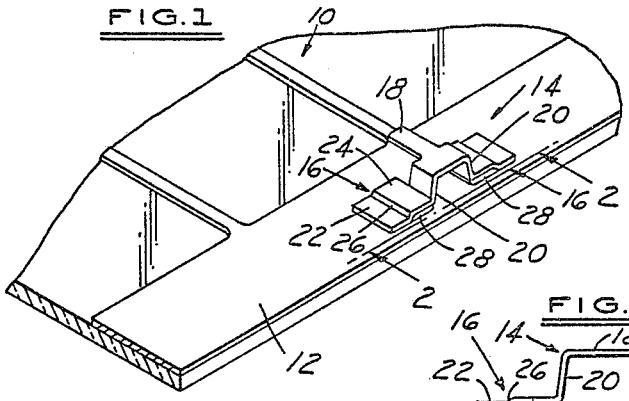
FIG. 1 is a perspective view of a portion of a thermal window having an electrical terminal formed in accordance with this invention bonded thereto.

In FIG. 1 there is seen a thermal window generally identified by the numeral 10. Such a window is normally employed as the rear window of a motor vehicle. The window has a heating grid 12 thereon which is composed of a main bus bar and individual heating grid lines, as is well known in the art. The grid may be a resistance metal or resistance composition, the shape and type and method of attachment to the glass being part of the prior art and unnecessary to be further described herein. In general, such windows have bus bars extending across opposite edges of the glass between which the individual grid lines extend.

In FIG. 1, there is shown an electrical terminal generally identified by the numeral 14 which is constructed in accordance with the teachings of this invention. In accordance with the preferred embodiment of this invention, the electrical terminal 14 has a pair of bonding feet generally identified by the numeral 16—16, a lead area 18, and offset areas 20—20 interconnecting the bonding feet 16—16 with the lead area 18. The terminal may be formed from a metal such as copper having a thickness of 0.030 inches.

Figure 2:
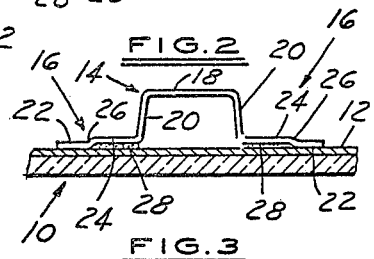
FIG. 2 is an enlarged elevation view of the terminal of FIG. 1 taken in the direction of arrow 2 of FIG. 1.
Figure 3:
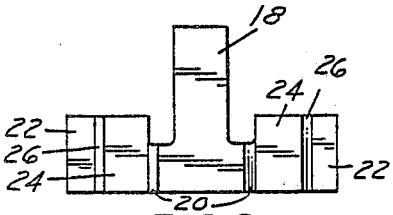
FIG. 3 is a bottom view of the terminal shown in FIGS. 1 and 2.

In accordance with a first embodiment of the electrical terminal of this invention, as best seen in FIGS. 1, 2 and 3, each of the bonding feet 16—16 is formed of a first planar portion 22 and a second planar portion 24 which are interconnected by an interconnecting portion 26. As best illustrated in FIGS. 1 and 2, the first planar portion 22 and the second planar portion 24 extend in spaced but substantially parallel planes. If the terminal is made from copper having a thickness of 0.030 inches, the planes are offset about 0.010 inches. Also, the first and second planar portions are generally in the form of rectangles.

In the normal course of events, the terminal 14 will have the bottom surfaces of both bonding feet 16—16 dipped in a solder bath so that some solder with adhere thereto and solidify. When it is desired to solder the terminal 14 onto the heating grid 12, an operator would place the presoldered terminal 14 on the grid 12 and then bring a resistance heating gun into engagement with both of the bonding feet 16—16. The gun would have a probe that contacts each of the bonding feet. The operator places the gun on the bonding feet, applies a downward pressure thereon, and then activates the gun so that the terminal is resistively heated. By resistant heating of the terminal, the solder thereon is melted and thereby joined to the heating grid.

By forming the terminal in accordance with the teachings of this invention, an operator may press down on the first planar portions 22—22 of the bonding feet 16—16 with as great a pressure as desired, and the second planar portions 24—24 of the bonding feet will remain in a predetermined position spaced above the surface of the heating grid 12. In such a manner, there is at least a predetermined amount of solder 28—28 located below the second planar portions 24—24 of the bonding feet 16—16 to provide the mechanism for securely attaching the terminal 14 to the heating grid 12.

Although the drawings do not show any solder, it is understood by those skilled in the art that there is also solder located below the first planar portions 22—22 of the bonding feet 16—16 which attach these portions of the terminal 14 to the heating grid 12. The amount of solder below the first planar portions would be determined by the amount of pressure which has been applied by the operator during the bonding operation.

By utilization of a terminal design in accordance with the teachings of this invention, the operator of the soldering device knows that he or she can place a great deal of force on the terminal 14 during the bonding operation and still develop a solder joined between the terminal and the heating grid 12 which will have the desired properties. It takes the guess work out of how much pressure the operator should apply during the soldering operation, and insures that the terminal is applied with the appropriate amount of solder between it and the heating grid.

Figure 4:
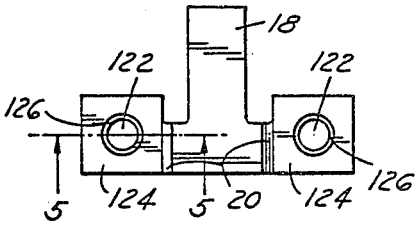
FIG. 4 is an alternate embodiment of an electric terminal in accordance with the teachings of this invention.
Figure 5:
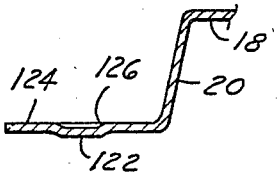
FIG. 5 is an enlarged cross-section view, taken along line 5—5 of FIG. 4.

In FIGS. 4 and 5, there is shown an alternate to the preferred construction shown in FIGS. 1, 2 and 3. In the terminal shown in FIGS. 4 and 5, the first planar portion 122 is defined as a circular area depressed from a second planar portion 124. The first planar portion is depressed centrally of the second planar portion 124 and is interconnected therewith by an interconnecting portion 126, best seen in FIG. 5. Once again, the first planar portion 122 and the second planar portion 124 define parallel planes that act in the same manner as the first planar portion 22 and second planar portion 24 of the terminal described in conjunction with FIGS. 1 to 3.

Figure 6:
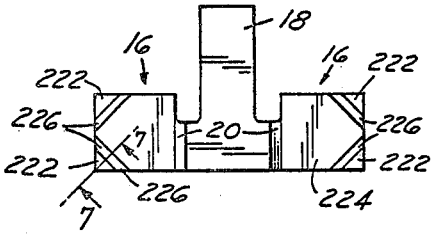
FIG. 6 is still another alternate form of an electric terminal in accordance with the teachings of this invention.
Figure 7:
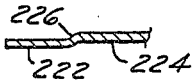
FIG. 7 is an enlarged cross-section view taken along line 7—7 of FIG. 6.

Still another form of the terminal of this invention is shown in FIGS. 6 and 7. In this case, the first planar portion 222 is formed from two separate triangular shaped areas on each of the bonding feet 16—16. These first planar portions are interconnected with a second planar portion 224 by means of a pair of interconnecting portions 226—226.

While particular embodiments of the invention have been illustrated and described, it will be obvious to those skilled in the art that various changes and modifications may be made to the terminal of this invention without departing from the invention. For example, a terminal might have a single bonding foot, two bonding feet, or more than two bonding feet, as is desired in its particular application. It is intended to cover in the appended claims all such modifications and equivalents as fall within the true spirit and scope of this invention.

What is claimed is:

1. In an electrical terminal for connecting a heating grid on a thermal window to a source of electric power in which the electrical terminal has at least one bonding foot and a lead area to which an electrical connection can be made, the lead area being integral with the bonding foot, the improvement comprising:

a bonding foot formed so as to have at least a first planar portion and a second planar portion and an interconnecting portion interconnecting said first and said second planar portions, said first and said second planar portions extending in spaced but substantially parallel planes so that when the terminal is solder bonded to a heating grid on a thermal window, said first planar portion of the bonding foot is in close proximity to the heating grid and said second planar portion of the bonding foot is spaced from but is interconnected by electrically conductive solder with the heating grid.

2. The electric terminal of claim 1 wherein said first and second and said second planar portions are generally in the form of rectangles.

3. The electric terminal of claim 1 wherein said first planar portion is in the form of a circle.

4. The electric terminal of claim 1 wherein said first planar portion is made up of at least two different non-interconnected areas.

5. The electric terminal as defined in claim 4 wherein said two non-interconnected areas are each generally triangular in configuration.

6. In an electrical terminal for connecting a heating grid on a thermal window to a source of electric power in which the electrical terminal has at least two bonding feet and a lead area to which an electrical connection can be made, the lead area being integral with the bonding feet, the improvement comprising:

a plurality of bonding feet, each of the bonding feet being formed so as to have at least a first planar portion and a second planar portion, and an interconnecting portion interconnecting said first and said second planar portions, said first and said second planar portions of each bonding foot extending in spaced but substantially parallel planes so that when the terminal is solder bonded to a heating grid on a thermal window, said first planar portion of each of the bonding feet is in close proximity to the heating grid and said second planar portion of each of the bonding feet is spaced from but is interconnected by electrically conductive solder with the heating grid.

7. The electric terminal of claim 6 wherein said first and said second planar portions of each of the bonding feet are generally in the form of rectangles.

8. The electric terminal of claim 6 wherein said first planar portion of each of the bonding feet is in the form of a circle.

9. The electric terminal of claim 6 wherein said first planar portion of each of the bonding feet is made up by at least two different non-interconnected areas.

10. The electric terminal as defined in claim 9 wherein said two non-interconnected areas of each of the bonding feet are each generally triangular in configuration.

* * * * *